US008925113B2

(12) United States Patent
Fricke et al.

(10) Patent No.: US 8,925,113 B2
(45) Date of Patent: Jan. 6, 2015

(54) PROTECTIVE HAND COVERING

(75) Inventors: William Patrick Fricke, Fairport, NY (US); Julianne Clas Baker, Fairport, NY (US)

(73) Assignee: The Crew Stop LLC, Fairport, NY (US)

( * ) Notice: Subject to any disclaimer, the term of this patent is extended or adjusted under 35 U.S.C. 154(b) by 422 days.

(21) Appl. No.: 13/031,338

(22) Filed: Feb. 21, 2011

(65) Prior Publication Data

US 2012/0210483 A1 Aug. 23, 2012

(51) Int. Cl.
*A41D 13/08* (2006.01)
*A63B 71/14* (2006.01)
*A63B 69/06* (2006.01)

(52) U.S. Cl.
CPC ..... *A63B 71/141* (2013.01); *A63B 69/06* (2013.01); *A63B 2209/10* (2013.01)
USPC ..... 2/16; 2/161.1

(58) Field of Classification Search
USPC ..... 2/16, 20, 161.1, 161.6, 163, 160; 294/25
See application file for complete search history.

(56) References Cited

U.S. PATENT DOCUMENTS 1,217,681 A * 2/1917 Baldridge ..... 441/58
1,716,221 A 6/1929 Fernie
2,547,388 A 4/1951 Griffin
3,269,728 A 8/1966 Blough
4,103,362 A 8/1978 Blakeman
4,570,269 A * 2/1986 Berlese ..... 2/16
5,079,776 A * 1/1992 Crawford ..... 2/20
5,490,290 A 2/1996 Gold
5,590,420 A * 1/1997 Gunn ..... 2/69
5,768,711 A 6/1998 Wissink
5,826,276 A 10/1998 Garceau-Verbeck
6,035,443 A 3/2000 Green
6,895,598 B1 5/2005 Sokolowski
D634,481 S * 3/2011 Davis ..... D29/117.1
2004/0107476 A1 6/2004 Goldwitz
2008/0235850 A1 * 10/2008 Cabauy et al. ..... 2/161.8
2009/0235429 A1 * 9/2009 Pickard et al. ..... 2/161.7

FOREIGN PATENT DOCUMENTS

EP 0653171 5/2005

* cited by examiner

*Primary Examiner* — Katherine Moran
(74) *Attorney, Agent, or Firm* — Brian B. Shaw, Esq.; Timothy W. Menasco, Esq.; Harter Secrest & Emery LLP

(57) ABSTRACT

A protective hand covering has a membrane to cover the palm surface of the hand, leaving the small finger exposed and having first, second, and third extended finger portions over palm surfaces of proximal and middle phalanges of ring, middle, index fingers, and having an extended thumb portion extending onto the palm side of the proximal phalanx of the thumb. A loop accepts the thumb and secures an edge of the extended thumb portion against the base of the thumb. Elastic bindings along edges of the finger portions of the membrane define holes for ring, middle, and index fingers. The elastic bindings urge the first, second, and third extended finger portions against palm side surfaces of proximal and middle phalanges of ring, middle, and index fingers. A cross strap extends across the dorsal side of the hand for releasable elastic tensioning.

15 Claims, 11 Drawing Sheets

PROTECTIVE HAND COVERING

FIELD OF THE INVENTION

This invention generally relates to hand covering apparel and more particularly to a protective hand covering that is especially suitable for rowing and related athletic activity.

BACKGROUND OF THE INVENTION

Competitive rowing, enjoyed for centuries, is seeing an upsurge in interest and is now held to be one of the fastest growing sports. The rowing sport has two major forms, sweep rowing in which the rower works a single oar with both hands, and sculling in which the rower works two oars (sculls), one in each hand. Various types of racing have been developed and rowing competitions range from Olympic and world championship levels, to rowing in schools, in clubs, and in less competitive arenas.

Although rowing is a low-impact, non weight-bearing sport, it has its hazards and drawbacks, due particularly to the repetitive and demanding nature of rowing action. One notable difficulty resulting from intense, competitive rowing activity relates to its impact on the rower's hands. During the repetitive rowing cycle, there can be considerable friction between the oar and the hands, causing calluses, blisters, and related damage to the skin of the rower's hands. As is well known among participants of the sport, the job of rowing can be exceptionally tough on palm-side surfaces of the hand.

Attempts to alleviate the problems caused by the repetitive, friction contact of oar against hand using conventional blister protection methods have met with limited success. In many cases, rowers wrap layers of adhesive dressing tape over areas of the hand that are particularly prone to damage. While this approach may work for a short period of time, the tape has a limited durability under competitive racing conditions and is typically worn off or discarded early into a race.

Other attempts to provide protection to the hands have included using gloves and adaptations of gloves. This solution is disappointing to rowers for a number of reasons. Perspiration from within the gloved hand is not only uncomfortable, but does not help, and may even hinder, protection from blistering. Padding against the palm surface proves to be wholly unsatisfactory over time, bunching up and creating localized pressure spots that can blister worse than other areas. Covering over the upper surfaces of the fingers prevents the type of gripping and flexing action needed to handle the oar properly and comfortably. Overall, gloves tend to restrict hand movement, causing more muscular stress and making the rowing experience much less enjoyable. Gloves easily get wet and stay wet, becoming uncomfortable in the heat of competition. And gloves worn for one race or event, even if not irreparably damaged or destroyed by the rowing action, are unlikely to be wanted for subsequent use.

For reasons such as these, gloves are not a welcome solution to the rowing community. Few competitive rowers like to use them and some coaches, competitions, or teams themselves may discourage or even prohibit the use of gloves during a race.

A desirable protective hand covering for rowing and similar activities that include repetitive, frictive contact against palm areas of the hand would meet the following requirements:

(i) buffers the skin contact without losing friction needed for oar handling, thus helping to protect the hand from injury;

(ii) allows air flow around the hand to prevent heat build-up and to help keep skin from getting clammy;

(iii) low-profile in appearance, looking like no more than tape to the external viewer;

(iv) durable, designed to last throughout practice and racing sessions and not easily damaged by moisture, sweat, and wear;

(v) easy to put on and remove;

(vi) offering minimal constraint to hand motion, not obstructive of hand flexure during the stroke cycle.

Adhesive tape fails or disappoints on requirements (ii), (iv), (v), and (vi) of the above listing. Glove arrangements fail or disappoint on requirements (i), (ii), (iii), (iv), (v), and (vi). Added padding, a conventional solution for reducing the tendency to cause blisters, impairs handling and "feel" of the oar for the rowing participant.

Thus, it is seen that there is a need for a protective hand covering that is particularly well suited for use in rowing and similar athletic, leisure, and work activities.

SUMMARY OF THE INVENTION

It is an object of the present invention to advance the art of hand protection for those engaged in rowing and related activities. With this object in mind the present invention provides a protective hand covering comprising:

a membrane formed to substantially cover the palm surface of the hand, leaving the small finger exposed and having first, second, and third extended finger portions formed to extend over palm surfaces of proximal and middle phalanges of ring, middle, index fingers, respectively, and having an extended thumb portion formed to extend onto the palm side of the proximal phalanx of the thumb;

a loop joined to the membrane and formed to accept the thumb and to secure at least an edge of the extended thumb portion against the base of the thumb;

elastic bindings attached along edges of the first, second, and third extended finger portions of the membrane and defining holes for insertion of the ring, middle, and index fingers, respectively, wherein the elastic bindings are disposed to urge the first, second, and third extended finger portions of the membrane against palm side surfaces of the proximal and middle phalanges of ring, middle, and index fingers, respectively; and a cross strap that is disposed to be extended across the dorsal side of the hand and to provide a releasable elastic tensioning that urges contact of the membrane against the palm.

It is a feature of the present invention that it provides a protective hand covering with bindings that draw a covering membrane over areas of the palm that undergo considerable friction during rowing. Advantageously, the protective hand covering of the present invention allows natural, essentially unconstrained motion of the hand during rowing. The back of the hand is exposed, except for bindings, leaving joints of the fingers exposed for ease of movement.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

In the context of the present disclosure, the use of terms such as "first", "second", "third", etc., does not by itself connote any priority, precedence, or order of a component or claim element over another or the temporal order in which acts of a method are performed. These terms may be used more generally as labels to distinguish one element having a certain name from another element having the same name (but for use of the ordinal term) or to distinguish the claim elements.

Figure 1A:
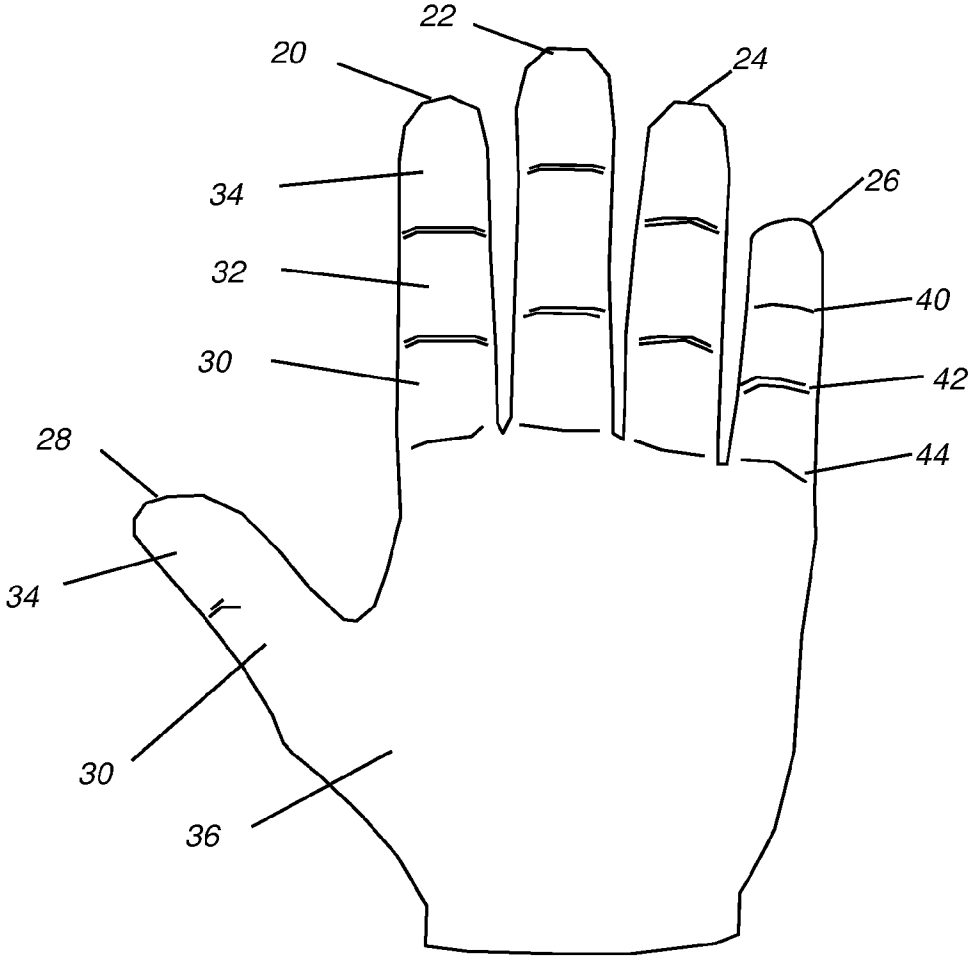
FIG. 1A is a plan view showing parts of the hand, from the palm or volar side.
Figure 1B:
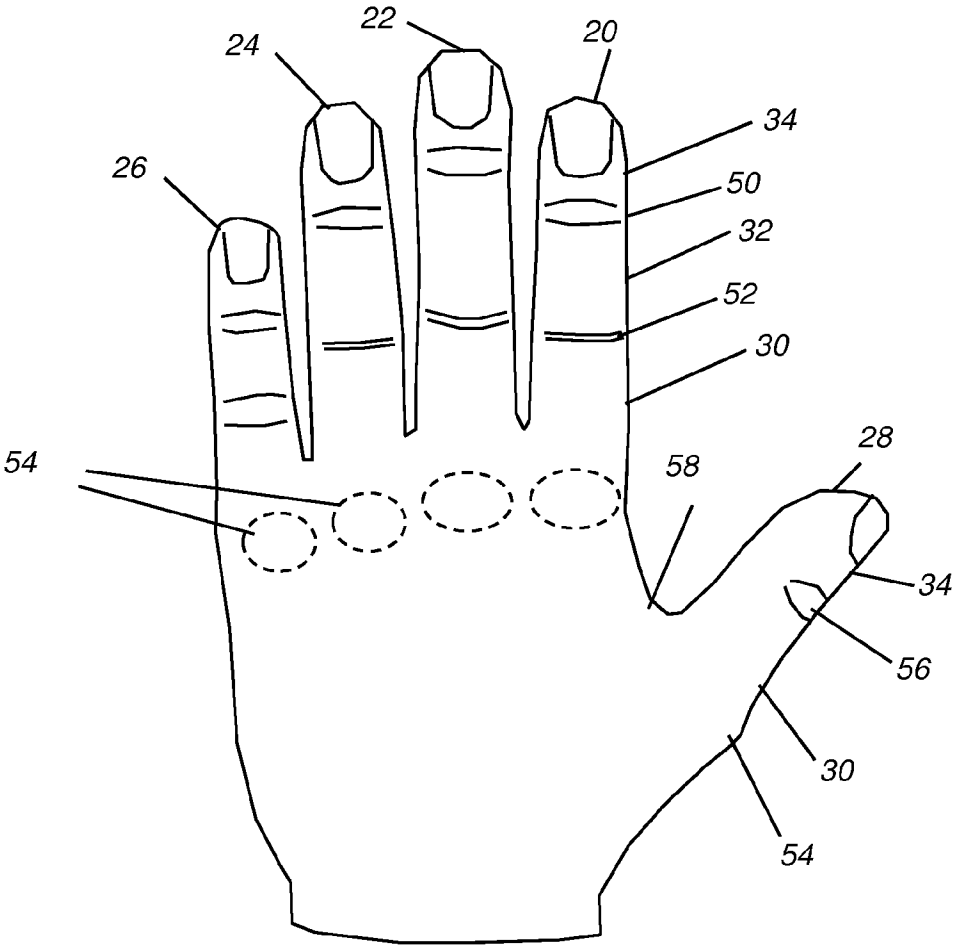
FIG. 1B is a plan view showing parts of the hand, from the back or dorsal side.

In order to have a better understanding of the protective hand covering of the present invention and a better understanding of terms used in the present disclosure, it is instructive to review some aspects of the anatomy of the hand. FIG. 1A shows the volar or palm side of the hand. FIG. 1B shows the dorsal or back side of the hand. The hand has an index finger 20, a middle finger 22, a ring finger 24, and a small finger or minimus 26. Each finger has three phalanges, a proximal phalanx 30, a middle phalanx 32, and a distal phalanx 34. Creases between phalanges are a distal interphalangeal (IP) crease 40, a proximal interphalangeal (IP) crease 42, and a palmar digital crease 44. The thumb 28 has only proximal and distal phalanges 30 and 34. The heel 36 of the palm generally includes the thenar eminence (ball of the thumb) below the base of the thumb 28.

The dorsal view of FIG. 1B shows a number of joints. A distal interphalangeal (IP) joint 50 is between distal and middle phalanges 34 and 32. A proximal interphalangeal (IP) joint 52 is between middle and proximal phalanges 32 and 30. A knuckle or metacarpophalangeal (MP) joint 54, outlined in dashed ellipses in FIG. 1B, is between the proximal phalanx 30 and the lower part of the hand. The thumb has an interphalangeal (IP) joint 56 between its proximal and distal phalanges 30 and 34. The base of the thumb 28 is considered to be the area just above its metacarpophalangeal joint 54. The crotch of the thumb is generally on the opposite (flexure) side or inside of metacarpophalangeal joint 54, as shown at 58.

For clarity of description and claims language, the present disclosure may use the general term "fingers" to mean specifically the grouping of index finger 20, middle finger 22, ring finger 24, and small finger or minimus 26. Thumb 28 is not considered to be in this grouping. This distinction is useful due to the particular nature of the hand covering that is taught herein.

Figure 2:
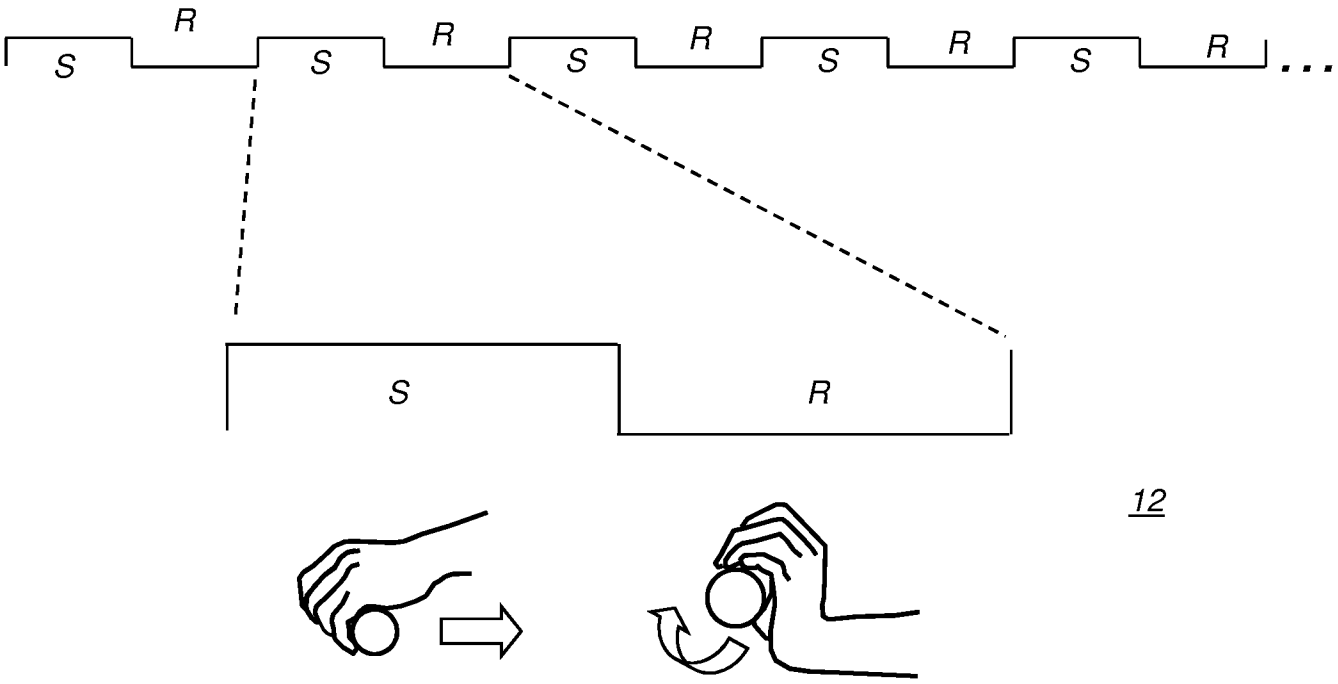
FIG. 2 is a schematic diagram showing repeated cycles used in rowing.

The term "rowing stroke cycle" as used in the present disclosure relates to the repetitive cycle of hand movements used while rowing. By way of example, FIG. 2 illustrates a rowing stroke cycle 12 from the sequence for one type of rowing. Here, rowing stroke cycle 12 has two basic portions, a stroke portion S and a return portion R. During stroke portion S, the rower pulls against the oar and pressure against the hand is predominantly against the upper part of the palm and lower part of fingers 20, 22, and 24. During the restore portion R, the rower moves the oar back into place for the next stroke. Here, pressure is directed more against the lower portions of the palm, including the heel of the palm. When feathering the oar, as used in sweep rowing and shown in FIG. 2, one wrist, on the "feather" hand, performs a twisting action in the restore portion R. This twisting motion exerts more frictive pressure against this hand than on the other "drive" hand.

Figure 3A:
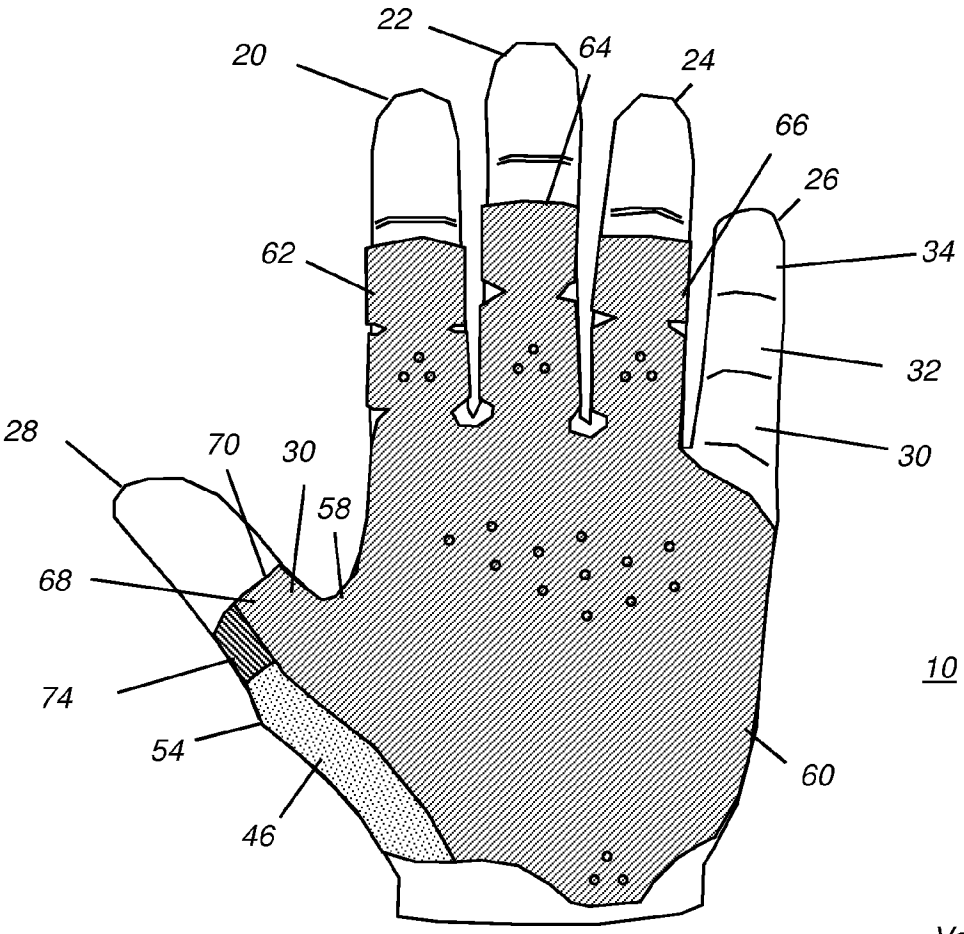
FIG. 3A is a plan view that shows a protective hand covering according to one embodiment of the present invention, from the palm side.
Figure 3B:
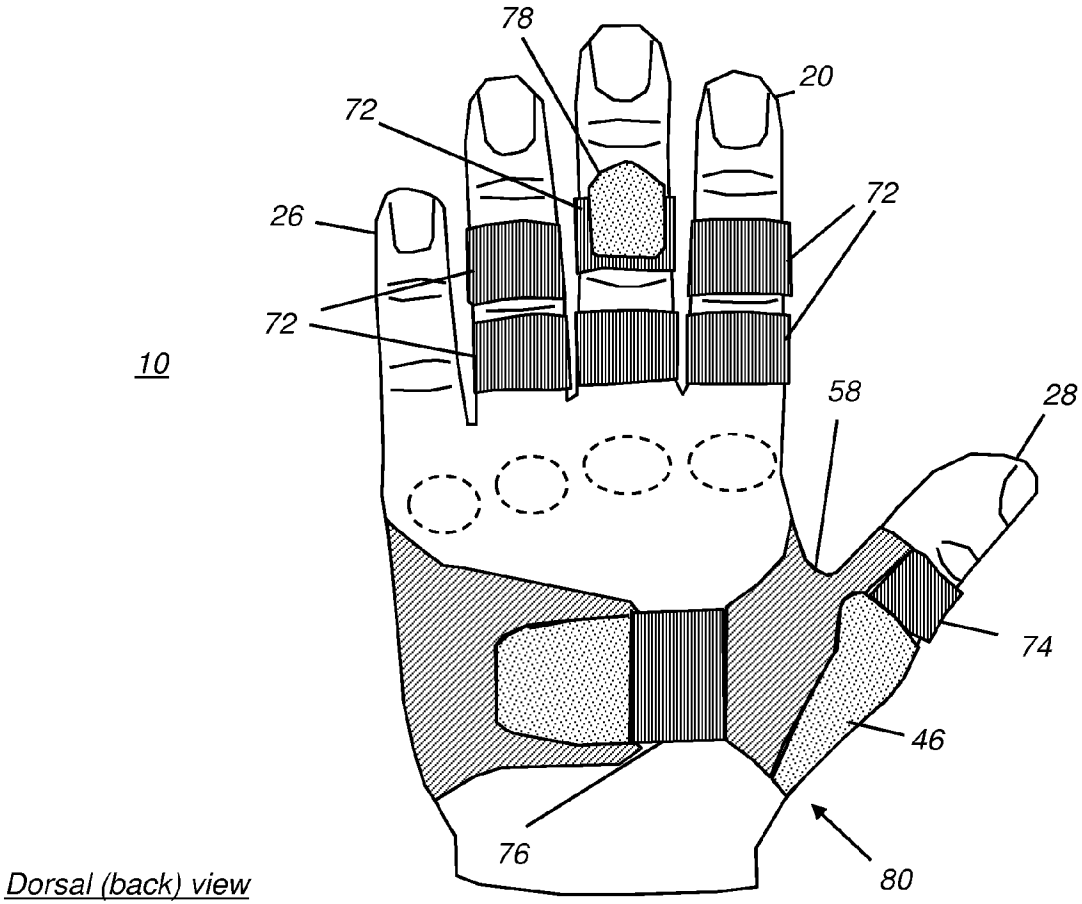
FIG. 3B is a plan view that shows a protective hand covering according to one embodiment of the present invention, from the dorsal side.

Unlike previous attempts that modify various glove designs in order to provide a protective hand covering that meets the needs of the rower, the inventors have addressed the problem of how and where blisters and calluses form and what type of protection works best given the particular demands of rowing. Consistent with an embodiment of the present invention, the plan views of FIGS. 3A and 3B show a protective hand covering 10 from volar (palm) and dorsal (back) views, respectively. A membrane 60 is formed to substantially cover the palm surface of the hand and to cover portions of the index, middle, and ring fingers 20, 22, and 24, while leaving the small finger 26 exposed. Membrane 60 has first, second, and third extended finger portions 62, 64, and 66 that are formed to cover proximal and middle phalanx 30 and 32 portions of each of index, middle, and ring fingers 20, 22, and 24, respectively. First, second, and third extended finger portions 62, 64, and 66 are separated from each other along at least a portion of their length and are optionally notched near the joints for improved flexure in the embodiment shown. Membrane 60 also has an extended portion 68 that is formed to extend onto the palm side of the proximal phalanx 30 of thumb 28 and at least partially wraps about crotch of thumb 58 at the position of a loop 70, near metacarpophalangeal joint 54, wherein loop 70 accepts thumb 28. In this way, loop 70 thus secures at least an edge of the extended thumb portion against the base of the thumb.

Figure 4:
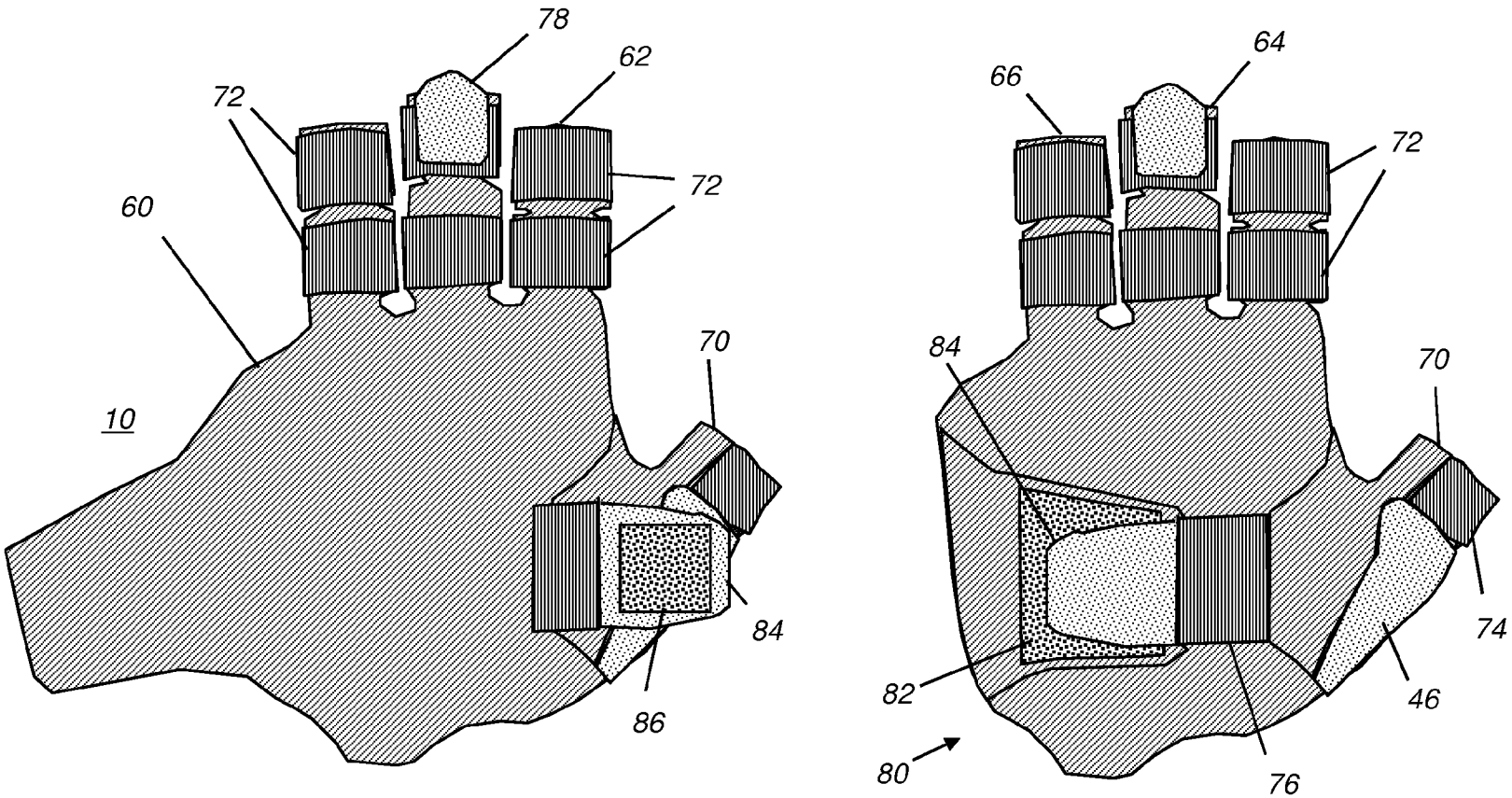
FIG. 4 is a view showing inside portions of the protective hand covering of FIGS. 3A and 3B.

As is shown more clearly in FIG. 3B, and shown separately from the hand in FIG. 4, a number of elastic bindings 72 are provided for first, second, and third extended finger portions 62, 64, and 66, attached along edges of the membrane 60 material and defining holes for insertion of the corresponding fingers. An additional elastic binding 74 is provided partially around the base of thumb 28. Another elastic binding 76 is provided as part of a cross strap 80 that secures protective hand covering 10 around the back (dorsal) surface of the hand or wrist. One or more optional tabs 78 may be provided as an aid to quick removal of hand covering 10. A portion 46 of a flexible fabric, such as nylon or other material, is joined to membrane 60 around and below the base of the thumb.

A number of useful features can be observed from the configuration of protective hand covering 10 described with reference to FIGS. 3A, 3B, and 4, including the following:

(i) Membrane 60 is preferably maintained under some at least slight amount of tension when it is secured about the hand, so that the membrane material stretches across, or is at least urged against, the palm surfaces that it covers. For example, bindings 72 at each extended finger portion 62, 64, and 66 urge these portions of membrane 60 against the palm surfaces of these fingers. Cross strap 80, fitted across the dorsal side of the hand, provides an elastic tensioning that urges contact of the membrane 60 against palm surfaces on the opposite (volar) side. Movement of membrane 60 across the palm surface and bunching is thus discouraged by an arrangement of binding and tensioning features designed to urge membrane 60 against the surface of the palm.

(ii) Joints 50, 52, and 54 of each of fingers 20, 22, 24, and 26 are preferably left exposed on the dorsal side and therefore are not constrained, from being able to flex easily, by bindings 72. Metacarpophalangeal joint 54 of thumb 28 may optionally be covered as shown in the FIG. 3A/3B embodiment, but is not required to flex appreciably during the rowing stroke cycle.

(iii) The dorsal side of the hand, as shown in FIG. 3B, is largely exposed, except where bindings are needed, as noted earlier.

It can be appreciated that the arrangement of bindings 72 for finger portions 62, 64, and 66 can be varied within the scope of the present invention. In the embodiment of FIG. 4, the extended finger portions 62, 64, and 66 are formed to lie against the palm surfaces only. In the embodiment shown in FIG. 5, more of the finger surface is covered by the membrane material, so that bindings 72 can be made somewhat shorter. Two bindings 72 are shown at each finger in the exemplary embodiments of FIGS. 3A, 3B, 4, and 5. In an alternate embodiment, a single piece of elastic material is used, preferably with the elastic material slit at the position of the proximal IP joint 52 (FIG. 1B), so that this joint can move more freely.

It should also be noted that cross strap 80 can have a number of alternative configurations for placement, fastening, and tensioning. In the embodiment of FIG. 4, cross strap 80 has a lip 84 that has a fastener portion 86; a mating portion of cross strap 80 has a mating fastener portion 82. Fastener portions 82 and 86 are hook-and-loop fasteners, such as separable flexible hook-and-loop or hook-and-pile connectors. One such type of fastener is the VELCRO® fastener from Velcro Industries B.V., Amsterdam, NL, for example. In alternative embodiments, various other types of releasable fasteners are used, such as buckles, snaps, and elastic loops, for example. Particularly advantageous are low-profile fasteners that can be attached or unfastened by the rower with a single action and that have few parts, with no dangling parts and with no parts that would abrade the skin surface during the stroke cycle. A slit can also be provided along an edge of membrane 60 that wraps about the dorsal side, allowing a different wrapping arrangement of cross strap 80.

Figure 5:
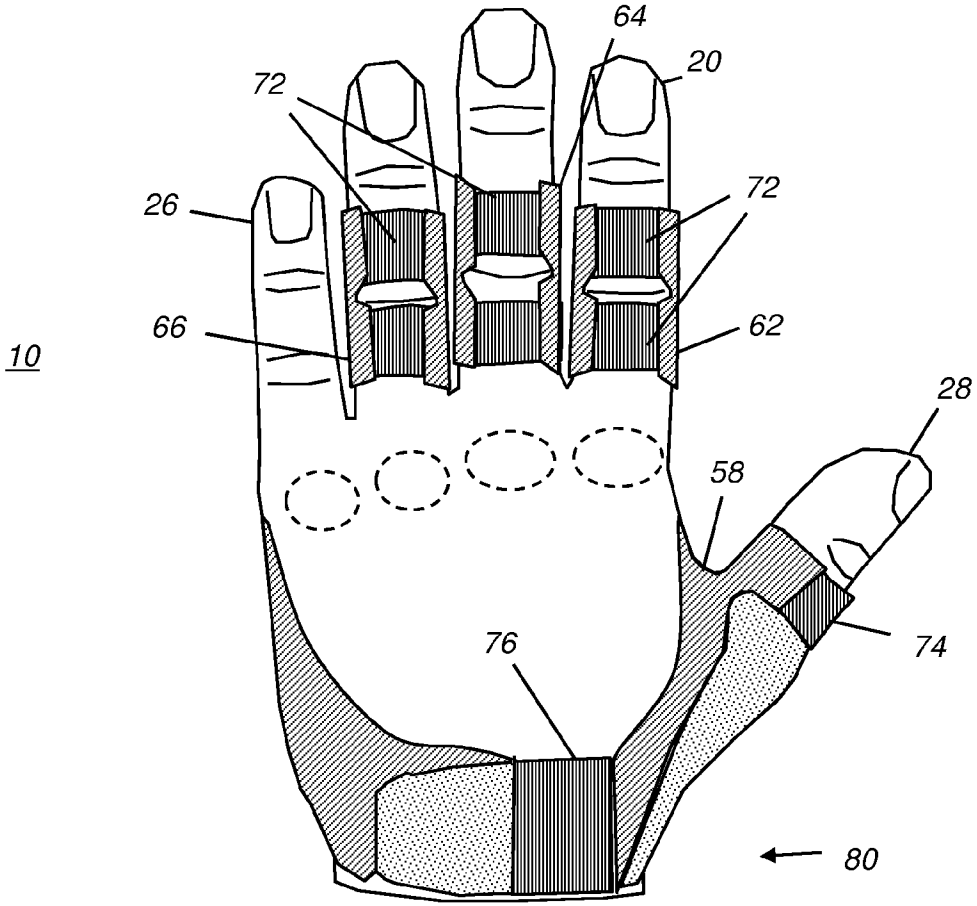
FIG. 5 is a plan view that shows a protective hand covering according to an alternate embodiment of the present invention, from the dorsal side.

The embodiment of FIG. 5 shows an alternate configuration in which cross strap 80 is wrapped across the dorsal side of the hand, but is positioned more toward the wrist than shown in FIG. 3B, leaving additional area of the dorsal surface of the hand itself exposed.

Membrane 60 can be any of a number of suitable materials, natural or synthetic, that have suitable durability and friction characteristics. Unlike solutions for other apparel or apparatus that are designed to prevent blisters or calluses in athletic or work activities, membrane 60 is provided without added cushioning in a preferred embodiment. Instead, a single, unlined material is preferred, so that there is only one layer of material, membrane 60, between the palm surface and the oar, for example. Added layers of lining materials, instead of helping to eliminate forces that cause continuing friction against the skin, can tend to bunch up over localized areas where high pressure is exerted, such as between the palm and oar surface, and can cause problems once such bunched areas appear.

Materials that have been found to be usable for membrane 60 include leather, including treated leather such as Oiltac™ leather from Pittards, Somerset, GB, and synthetic materials such as Maxkin™ from Korea Micro Fibre Co., Ltd., a sueded fabric polyester/spandex blend, neoprene, and various other materials formed from polyurethane and polyester materials. Membrane 60 can be from woven or unwoven material. Preferably, membrane 60 itself is continuous, that is, without seams or un-seamed, over the palm area. The membrane can be pre-formed into a partially curled shape for improved grip. The outer and inner surfaces of membrane 60 (with the inner surface against the skin of the palm) can have different finish treatments, both for appearance and performance.

Figure 6:
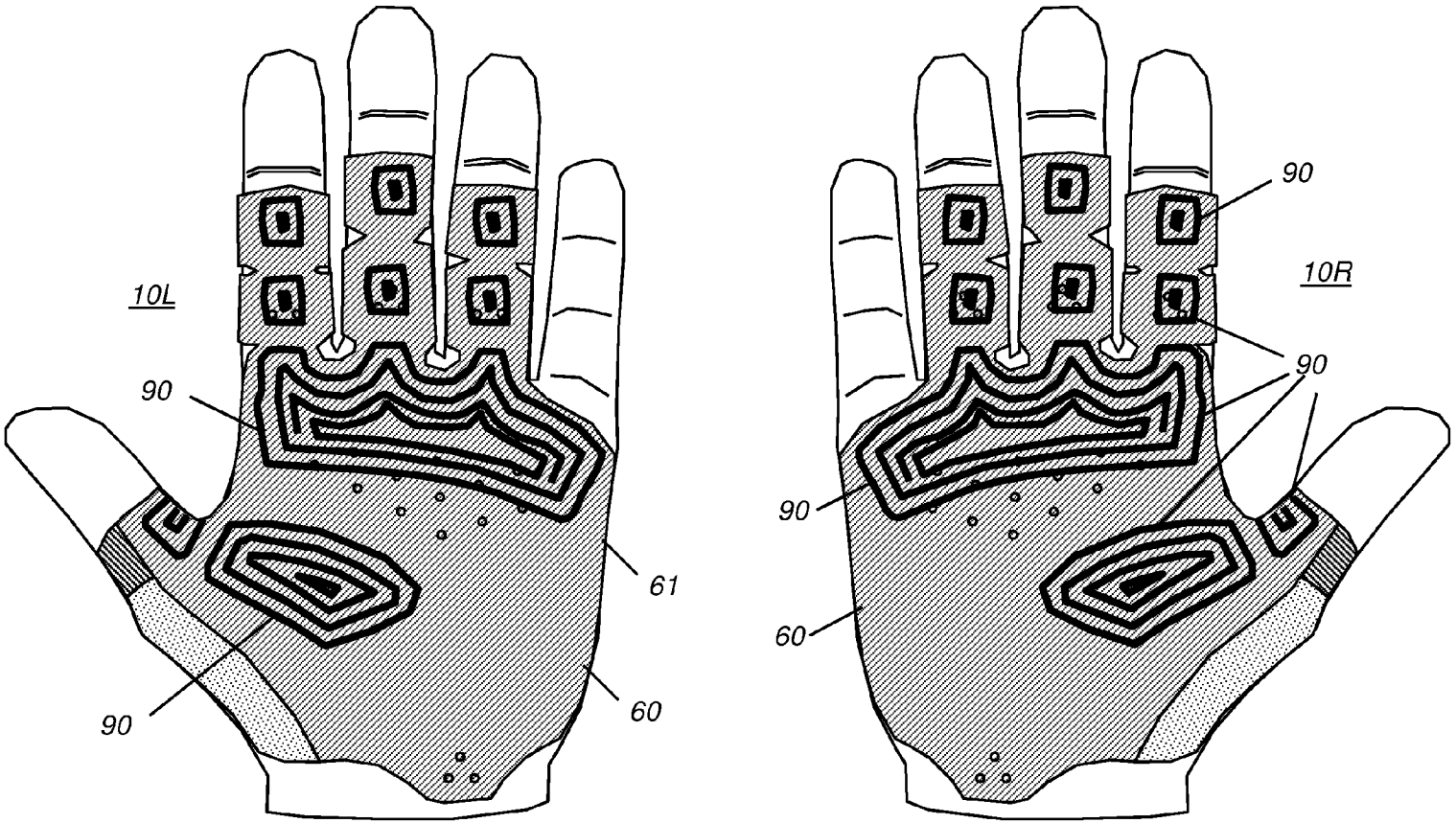
FIG. 6 is a plan view of palms of paired left and right protective hand coverings showing a deposited pattern on the outside surface of the membrane for grip enhancement.
Figure 7:
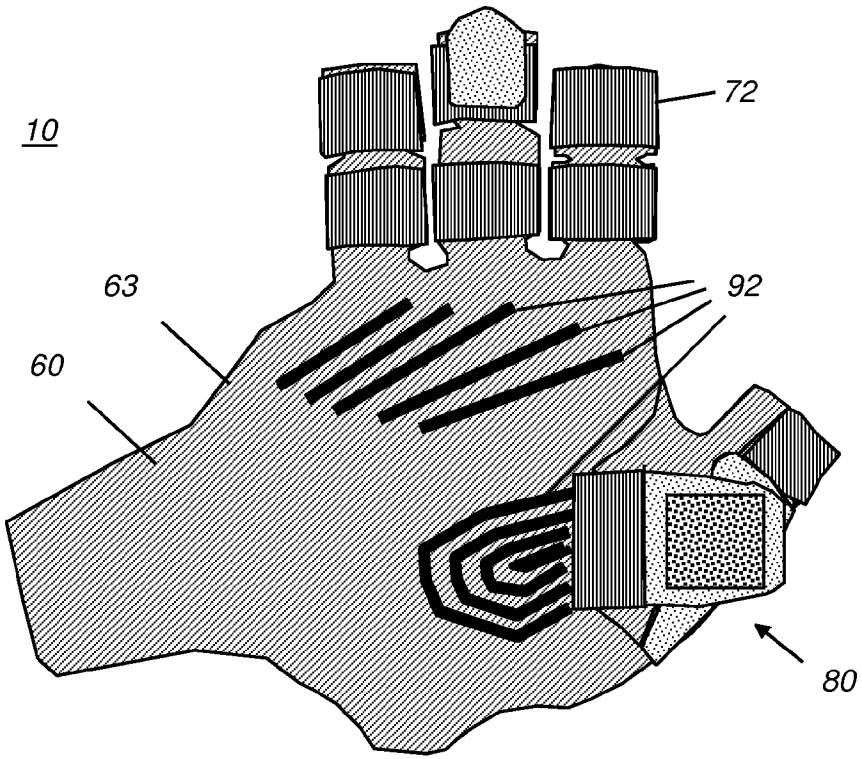
FIG. 7 is a view that shows a deposited pattern for grip enhancement on the inside surface of the membrane of a protective hand covering.

Various types of featuring can be used to aid in providing additional grip. FIG. 6 shows a pair with a left hand covering 10L and a right hand covering 10R having a pattern of features 90 deposited onto an outer surface 61 of membrane 60 using a silicone material or other type of friction-enhancing or adhesion assisting material. This helps to provide improved frictional contact with the oar. Features can also be used where membrane 60 faces the skin. By way of example, FIG. 7 shows a pattern of features 92 deposited on an inner surface 63 of membrane 60 to improve friction between the palm and membrane 60. In an alternate embodiment, membrane 60 is formed with features on its own surface for enhancing grip. Features are molded directly into the surface of membrane 60, as the material itself is fabricated, in one embodiment.

Figure 8:
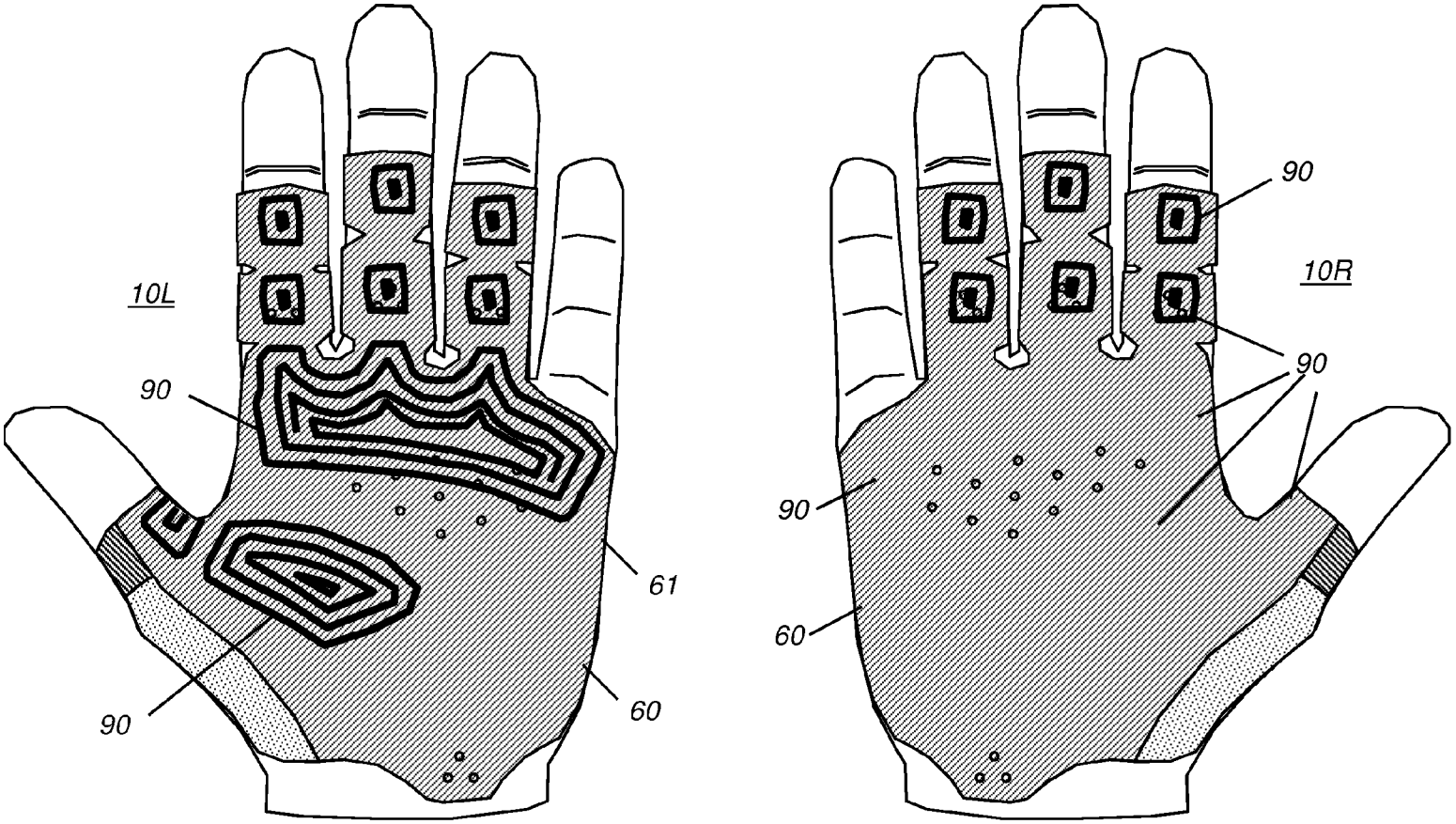
FIG. 8 is a plan view of palms of paired left and right protective hand coverings showing different deposited patterns on the outside surface of the membrane for grip enhancement.

Effective design of featuring allows protective hand covering 10 to be used for various types of rowing, including sweep rowing, in which the right and left hands of the rower have different action during the feathering half of the rowing stroke cycle, as noted previously. For example, for a rower on the port side, the left hand is used to provide the twisting action that feathers the oar, rotating it a number of degrees with respect to its longitudinal axis as shown in FIG. 2, while the right hand (drive hand) does not impart rotational movement but simply encircles the oar and provides a "bearing" for the oar rotation, imparting as little friction as possible during this part of the stroke cycle. Added friction helps the left hand to perform the feathering action. Reduced friction, meanwhile, allows the right hand to support feathering. Thus, for this type of rowing, right-handed and left-handed hand coverings 10 are designed with a different pattern of features 90 of adhesion assisting material. By way of example, FIG. 8 shows left and right protective hand coverings 10L for the feather hand and 10R for the drive hand. Here, right hand covering 10R may have no added features or, as in this example, have added features on finger portions only, and may have its surface treated differently than the left hand covering 10L is treated. In one embodiment, following the port rower example, a pair of hand coverings for the rower has its right hand covering 10R as shown to the right in FIG. 8 and its left hand covering 10L as shown at the left in FIG. 8.

Figure 9:
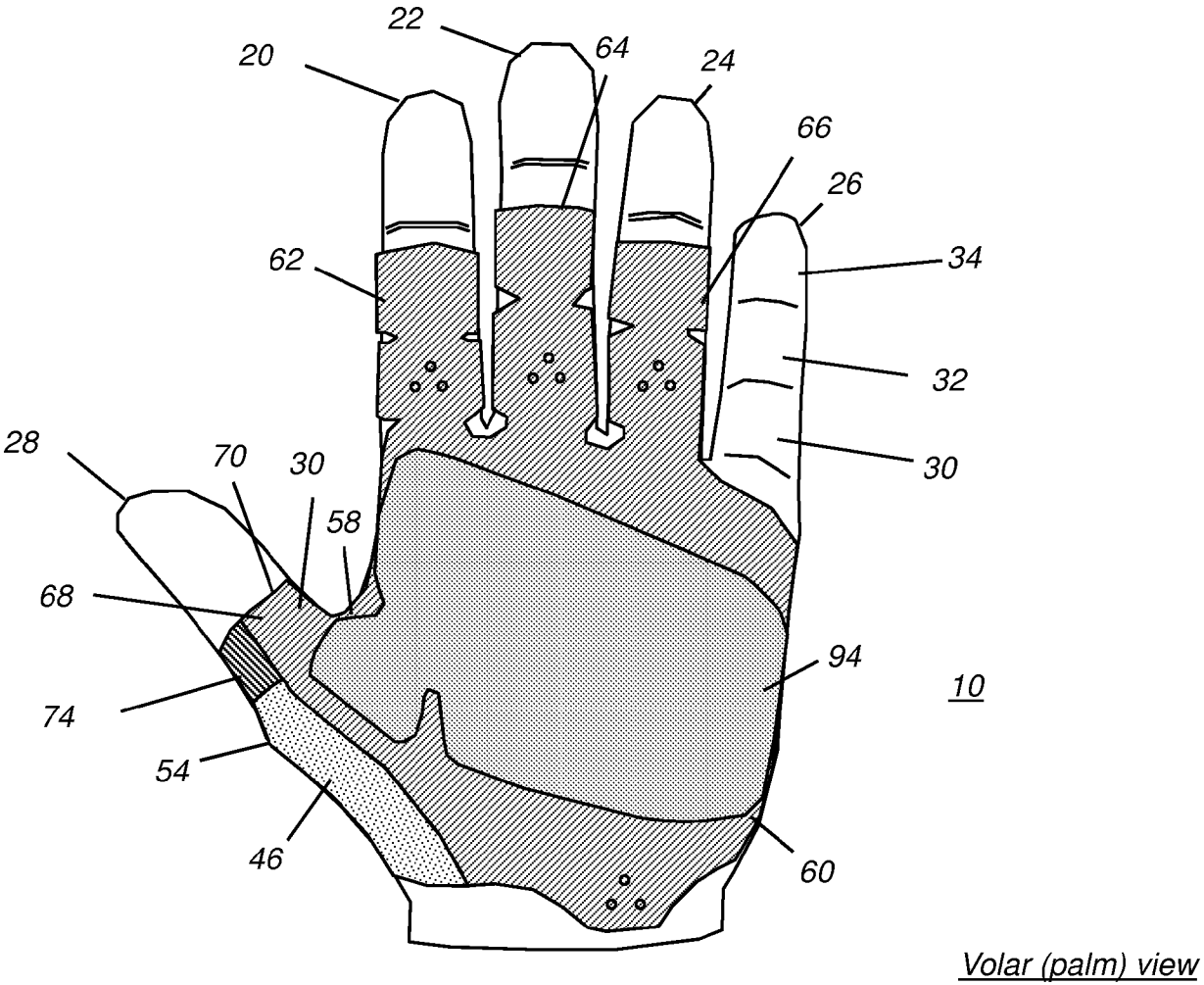
FIG. 9 is a plan view that shows an alternate embodiment of the protective hand covering that has an added layer for reducing friction.

The plan view of FIG. 9 shows an alternate embodiment of protective hand covering 10 that has an added layer 94 as part of membrane 60 for reducing friction. The example shown in FIG. 9 would be for the reverse example, that is, for a rower on the starboard side, so that the left hand serves as the drive hand and must have reduced friction. One suitable material that can be added to reduce friction is Ax Suede™ from Matmarket Inc., Portsmouth, N.H. This material is selected as having a lower frictional coefficient than the membrane 60. It must be emphasized that the material that is used for such a purpose and its overall pattern must be carefully considered in order to provide the proper amount of reduced friction and, at the same time, avoid bunching.

Advantageously, the protective covering of the present invention buffers skin contact against the oar, without losing friction needed for oar handling. Its open-backed design allows air flow around the hand to prevent heat build-up and to help keep the palms and other hand surfaces dry. The protective covering of the present invention is generally low-profile in appearance, having the general appearance of tape, as conventionally used by rowers. With selection of a suitable membrane material and well-constructed bindings, the protective covering of the present invention is durable, designed to last and to be re-usable after a competition, not easily damaged by moisture, sweat, and wear. The design of the protective covering allows it to be easy to fit onto the hand and to remove. During rowing, the protective covering of the present invention does not constrain hand motion and is not obstructive of hand flexure during the stroke cycle.

While the description provided herein is directed largely to rowing activity, the protective hand covering of the present invention could also be used for other types of athletic, leisure, and work activities.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. For example, a range of different types of materials could be used for providing elastic tension in the various bindings that are used as part of protective covering 10. Various tensioning mechanisms could be used to provide elasticity.

Thus, what is provided is a protective hand covering that is especially suitable for rowing and related athletic activity.

PARTS LIST

10, 10L, 10R. Protective hand covering
12. Stroke cycle
20. Index finger
22. Middle finger
24. Ring finger
26. Small finger
28. Thumb
30. Proximal phalanx
32. Middle phalanx
34. Distal phalanx
36. Heel
40. Distal interphalangeal crease
42. Proximal interphalangeal crease
44. Palmar digital crease
46. Portion
50. Distal interphalangeal joint
52. Proximal interphalangeal joint
54. Metacarpophalangeal joint
56. Interphalangeal joint
58. Crotch of thumb
60. Membrane
61. Outer surface
62, 64, 66. Extended finger portion
63. Inner surface
68. Extended portion
70. Loop
72. Binding
74. Binding
76. Binding
78. Tab
80. Cross strap
82. Fastener portion
84. Lip
86. Fastener portion
90, 92. Features
94. Added layer

The invention claimed is:

1. A protective hand covering comprising:

a membrane formed to substantially cover the palm surface of the hand, leaving the small finger completely exposed, the membrane comprising a palm portion, a dorsal portion, a first extended finger portion, a second extended finger portion, a third extended finger portion, and an extended thumb portion, wherein an edge of the third extended finger portion transitions downwardly continuing to form an upper edge of the dorsal portion, and wherein the first, second, and third extended finger portions extend over palm surfaces of proximal and middle phalanges of ring, middle, index fingers, respectively, and the extended thumb portion extends onto the palm side of the proximal phalanx of the thumb;

a loop joined to the membrane and formed to accept the thumb and to secure at least an edge of the extended thumb portion against the base of the thumb;

elastic bindings attached along edges of the first, second, and third extended finger portions of the membrane and defining holes for insertion of the ring, middle, and index fingers, respectively, wherein the elastic bindings comprise at least two elastic bindings attached along the edges of each of the first, second, and third extended finger portions of the membrane, wherein the elastic bindings are disposed to urge the first, second, and third extended finger portions of the membrane against palm side surfaces of the proximal and middle phalanges of ring, middle, and index fingers, respectively; and a cross strap that is connected to the extended thumb portion of the membrane and is disposed to be extended across the dorsal side of the hand and to provide a releasable elastic tensioning that urges contact of the membrane against the palm.

2. The protective hand covering of claim 1 wherein the membrane is formed from a material taken from leather, a polyurethane blend, a polyester fabric, and a neoprene material.

3. The protective hand covering of claim 1 wherein an inner surface of the membrane, for facing the palm, is patterned with an adhesion assisting material.

4. The protective hand covering of claim 1 wherein an outer surface of the membrane is patterned with an adhesion-assisting material.

5. The protective hand covering of claim 1 wherein the cross strap further comprises a hook-and-loop fastener.

6. The protective hand covering of claim 1 wherein the elastic bindings attached along edges of the first, second, and third extended finger portions of the membrane expose the proximal interphalangeal joint of at least one of the ring, middle, and index fingers at least during flexure of the hand.

7. The protective hand covering of claim 1 wherein one or more edges of one or more of the first, second, and third extended finger portions are notched.

8. The protective hand covering of claim 1 wherein the loop further provides an elastic tensioning about the base of the thumb.

9. The protective hand covering of claim 1 wherein the membrane is un-seamed across surfaces that contact the palm of the hand.

10. The protective hand covering of claim 1 wherein the membrane is pre-formed into a partially curled shape.

11. The protective hand covering of claim 1 wherein the membrane is a single layer of material.

12. The protective hand covering of claim 1 wherein the membrane has molded features for improved grip.

13. The protective hand covering of claim 1 wherein a second material having a lower frictional coefficient than the membrane is attached to the membrane.

14. A protective hand covering comprising:

a single-layer, un-seamed membrane formed to substantially cover the palm surface of the hand, leaving the small finger completely exposed, the membrane comprising a palm portion, a dorsal portion, a first extended finger portion, a second extended finger portion, a third extended finger portion, and an extended thumb portion, wherein an edge of the third extended finger portion transitions downwardly continuing to form an upper edge of the dorsal portion, and wherein the first, second, and third extended finger portions extend over palm surfaces of proximal and middle phalanges of ring, middle, index fingers, respectively and the extended thumb portion extends onto the palm side of the proximal phalanx of the thumb;

a loop joined to the membrane and formed to accept the thumb and to secure at least an edge of the extended thumb portion against the base of the thumb, wherein the loop comprises an elastic material;

elastic bindings attached along edges of the first, second, and third extended finger portions of the membrane and defining holes for insertion of the ring, middle, and index fingers, respectively, wherein the elastic bindings comprise at least two elastic bindings attached along the edges of each of the first, second, and third extended finger portions of the membrane, wherein the elastic bindings are disposed to urge the first, second, and third extended finger portions of the membrane against palm side surfaces of the proximal and middle phalanges of ring, middle, and index fingers, respectively; and a cross strap that is connected to the extended thumb portion of the membrane and is disposed to be extended across the dorsal side of the hand and to provide a releasable elastic tensioning that urges contact of the membrane against the palm, wherein the cross strap comprises a hook-and-loop fastener.

15. A pair of protective hand coverings, one for the right hand and one for the left hand, wherein each protective hand covering comprises:

a membrane formed to substantially cover the palm surface of the corresponding hand, leaving the small finger completely exposed, the membrane comprising a palm portion, a dorsal portion, a first extended finger portion, a second extended finger portion, a third extended finger portion, and an extended thumb portion, wherein an edge of the third extended finger portion transitions downwardly continuing to form an upper edge of the dorsal portion, and wherein the first, second, and third extended finger portions extend over palm surfaces of proximal and middle phalanges of ring, middle, index fingers, respectively, and the extended thumb portion extends onto the palm side of the proximal phalanx of the thumb;

a loop joined to the membrane and formed to accept the thumb and to secure at least an edge of the extended thumb portion against the base of the thumb;

elastic bindings attached along edges of the first, second, and third extended finger portions of the membrane and defining holes for insertion of the ring, middle, and index fingers, respectively, wherein the elastic bindings comprise at least two elastic bindings attached along the edges of each of the first, second, and third extended finger portions of the membrane, wherein the elastic bindings are disposed to urge the first, second, and third extended finger portions of the membrane against palm side surfaces of the proximal and middle phalanges of ring, middle, and index fingers, respectively; and a cross strap that is connected to the extended thumb portion of the membrane and is disposed to be extended across the dorsal side of the corresponding hand and to provide a releasable elastic tensioning that urges contact of the membrane against the palm, wherein one hand covering in the pair has a pattern of an adhesion assisting material applied to the palm surface of the membrane and the other hand covering in the pair has, attached to the palm surface of the membrane, a second material having a lower frictional coefficient than the membrane.

* * * * *